US008857514B2

(12) United States Patent
McFall

(10) Patent No.: US 8,857,514 B2
(45) Date of Patent: Oct. 14, 2014

(54) METHOD AND SYSTEMS TO SEVER WELLBORE DEVICES AND ELEMENTS

(75) Inventor: Alan L. McFall, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 300 days.

(21) Appl. No.: 13/421,302

(22) Filed: Mar. 15, 2012

(65) Prior Publication Data

US 2012/0234542 A1 Sep. 20, 2012

Related U.S. Application Data

(60) Provisional application No. 61/453,387, filed on Mar. 16, 2011.

(51) Int. Cl.

| | |
|---|---|
| ***E21B 29/02*** | (2006.01) |
| ***E21B 33/124*** | (2006.01) |
| ***E21B 29/00*** | (2006.01) |

(52) U.S. Cl.

CPC ..... *E21B 29/00* (2013.01); *E21B 33/124* (2013.01)

USPC ..... 166/297; 166/55.6

(58) Field of Classification Search

CPC ..... E21B 29/005; E21B 29/02

USPC ..... 166/297, 55.6

See application file for complete search history.

(56) References Cited

U.S. PATENT DOCUMENTS

2006/0021748 A1* 2/2006 Swor et al. ..... 166/55

* cited by examiner

*Primary Examiner* — William P Neuder

(74) *Attorney, Agent, or Firm* — Mossman, Kumar & Tyler, PC

(57) ABSTRACT

A method for performing an operation in the wellbore may include at least partially separating a wellbore tubular while reducing a compression in a section of the wellbore tubular using a force applicator in the wellbore. An apparatus for performing the downhole operation may include a cutter configured to at least partially sever a wellbore tubular; and a force applicator configured to reduce a compression in a section of a wellbore tubular proximate to the cutter.

13 Claims, 2 Drawing Sheets

METHOD AND SYSTEMS TO SEVER WELLBORE DEVICES AND ELEMENTS

CROSS-REFERENCE TO RELATED APPLICATIONS

This application claims priority from U.S. Provisional Patent Application Ser. No. 61/453,387, filed Mar. 16, 2011, the disclosure of which is incorporated herein by reference in its entirety.

BACKGROUND OF THE DISCLOSURE

1. Field of the Disclosure

The disclosure herein relates generally to the field of severing a tubular member or other tools.

2. Background of the Art

During the construction of hydrocarbon producing wells and other subsurface structures, one or more tubular elements may be used. Common tubular elements include casings, liners, jointed drill pipe, and coiled tubing. Other devices that may include tubular components may include packers. Often, it may be desirable or necessary to remove such a tubular element from the well. If a portion of the tubular element becomes stuck in the well for some reason, then the tubular element may have to be severed. By severing the tubular element, the stuck portion may be left in the well while retrieving the remainder of the tubular element.

In some aspects, the present disclosure addresses the need for cutting tubulars and other items.

SUMMARY OF THE DISCLOSURE

In aspects, the present disclosure provides a method for performing an operation in the wellbore. The method may include at least partially separating a wellbore tubular while reducing a compression in a section of the wellbore tubular using a force applicator in the wellbore.

In aspects, the present disclosure provides an apparatus for performing a downhole operation. The apparatus may include a cutter configured to at least partially sever a wellbore tubular; and a force applicator configured to reduce a compression in a section of a wellbore tubular proximate to the cutter.

Examples of certain features of the disclosure have been summarized rather broadly in order that the detailed description thereof that follows may be better understood and in order that the contributions they represent to the art may be appreciated. There are, of course, additional features of the disclosure that will be described hereinafter and which will form the subject of the claims appended hereto.

BRIEF DESCRIPTION OF THE DRAWINGS

For a detailed understanding of the present disclosure, reference should be made to the following detailed description of the embodiments, taken in conjunction with the accompanying drawings, in which like elements have been given like numerals, wherein.

DETAILED DESCRIPTION OF THE DISCLOSURE

In aspects, the present disclosure provides devices and related methods for severing a wellbore tubular. In one embodiment, a localized portion of the tubular, e.g., one to four meters, may be mechanically isolated from a larger portion of the tubular. By mechanically isolated, it is meant that a force applying device may subject the isolated section to a force that reduces compressive forces in walls or physical structure at that isolated section. The force applying device may use hydraulic, electric, pneumatic and/or mechanical action. A suitable cutter is then used to at least partially sever the tubular at the isolated section. For instance, by applying a force equal or exceeding the compressive force acting on tube or pipe, a cutting element may make a continuous and non interrupted cut into the wall of the tubular without having compressive forces pinch the cutting element between the two sections being cut. As used herein, the compressive force or compression force is the force that urges the cut or partially cut sections into contact with one another.

Figure 1:
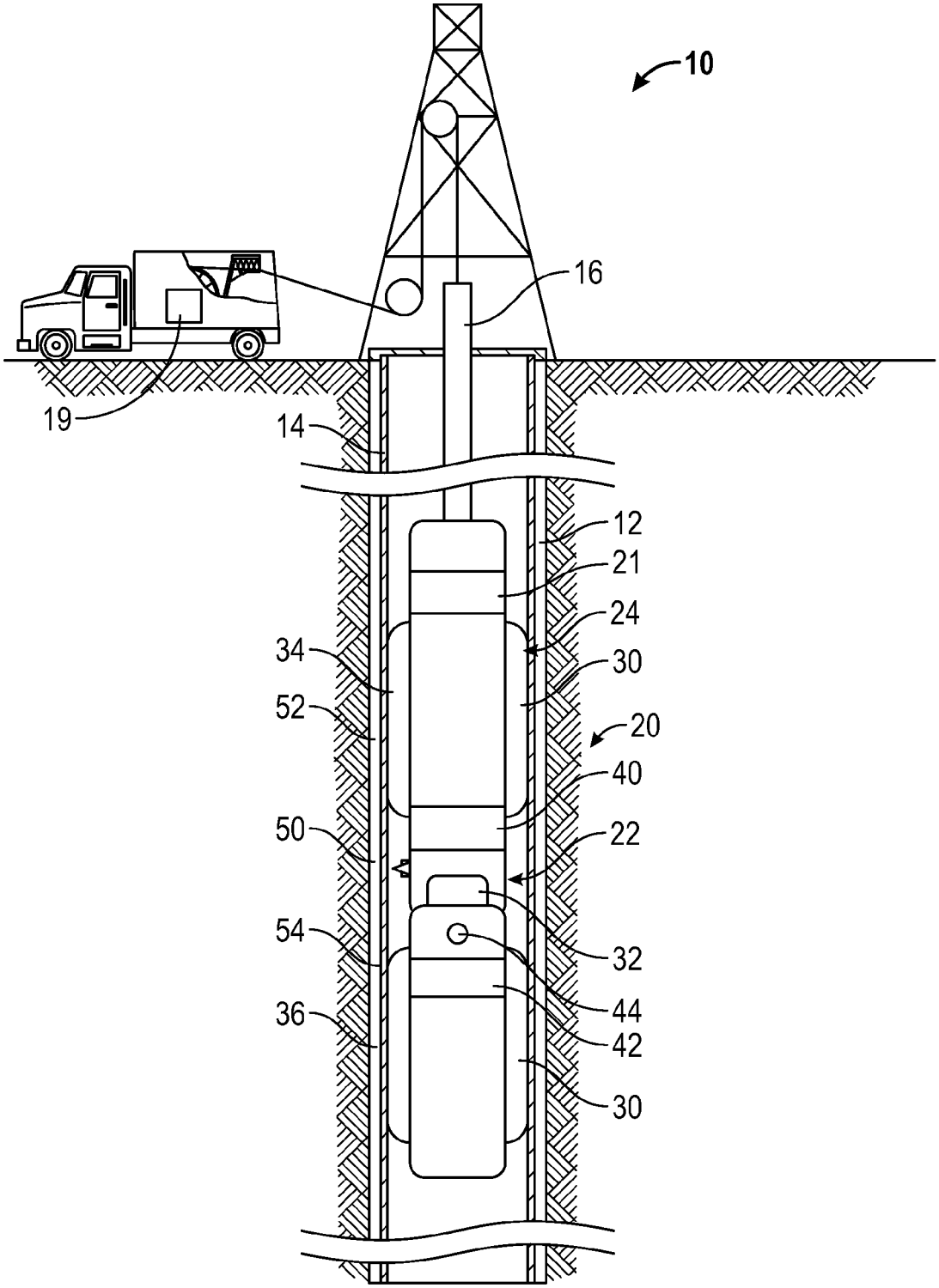
FIG. 1 illustrates one embodiment of a cutting tool made in accordance with the present disclosure.

FIG. 1 is a schematic diagram showing a rig 10 positioned over a wellbore 12. The wellbore 12 may include a wellbore tubular 14, such as a casing. It should be understood, however, casing is merely illustrative of a wellbore item that may be severed. Other wellbore items include liners, jointed drill pipe, coiled tubing, screens, production tubing, packers, etc. In one embodiment, a cutting device 20 may be used to separate the wellbore tubular 14 into two sections. A carrier 16, which may be wireline, e-line, slickline, jointed tubulars or coiled tubing, may include power and/or data conductors such as wires for providing bidirectional communication and power transmission between the surface and the cutting device 20. For example, a controller 19 may be placed at the surface for receiving data from the cutting device 20 and transmitting instructions to the cutting device 20. The controller 19 may include a processor, a storage device, such as memory, for storing data and computer programs. The processor accesses the data and programs from the storage device and executes the instructions contained in the programs to control the cutting operation. Also, a downhole controller 21 may be used to control the cutting device 20. The controllers 19, 21 may work independently or cooperatively.

In one embodiment, the cutting device 20 may include a cutter 22 and a force applicator 24. The cutter 22 may be configured to progressively cut into the wall of the tubular 14 to form two sections while the force applicator 24 applies an appropriately oriented force (e.g., a force countering the compression force) to the tubular 14. This tension force may minimize or prevent compressive forces from either pinching a cutting element between the two sections and/or allowing the compressive forces from rejoining the two sections. The tension force is applied close enough to the cutter 22 in order to counteract the compressive forces to a degree that the cutter 22 can operate to efficiently cut the tubular 14, e.g., the tension force is sufficiently proximate to the cutter 22.

The force applicator 24 is configured to apply a force to the tubular 14 that at least reduces a compression in the tubular 14. In one embodiment, the force applicator 24 may include anchors 30 and a force generator 32. The anchors 30 engage the tubular 14 at upper and lower engagement points 34, 36, respectively. An axial region between the points 34, 36 may hereafter be referred to as an isolated region or a controlled region. The force generator 32 applies a longitudinal or axially oriented force that urges the anchors 30 in opposing directions. As used herein, the term longitudinal or axial means co-axial with the long axis of the tubular 14, e.g., the direction of fluid flow in either an uphole or downhole direction. In one embodiment, the anchors 30 may be a device that centers and/or stabilizes the cutting tool 20 in the tubular 14. Centralizers and stabilizers generally include one or more radially extendable fins or pads that position a tool in a desired orientation in a bore and may maintain that orientation as the tool is operated. For example, the anchors 30 may include radially extendable slips having gripping elements (e.g., serrated edges). Devices such as a piston (not shown) may extend the slips radially outward when supplied with the pressurized fluid (e.g., gas or liquid) from a suitable source, e.g., a hydraulic circuit 40. The anchors 30 may include elements pads, inflatable members that expand to press the pads or gripping elements against a surface of the tubular 14. In certain embodiments, the pads may be configured to partially or fully penetrate into a wall of the tubular 14. In some embodiments, the anchors 30 may be configured to form a fluid seal with the surface that is engaged (e.g., a gas-tight seal, a liquid-tight seal, etc.). Also, in certain embodiments, one or more of the anchors 30 may be pre-existing in the well. For example, the anchor(s) 30 may be a packer, a bridge plug, or other well tool.

The force generator 32 may be a hydraulically actuated ram (e.g, telescopic tubulars that expand), an electro-mechanical device (e.g., an electric motor coupled to a worm gear), a hydraulic device (e.g., a hydraulic motor coupled to a drive train), or any other device configured to generate a force. The force generator 32 may be energized by the power source for the anchors 30 or a separate power source. Also, it should be understood that the force applicator 24 is shown in schematic form only in FIG. 1. That is, while the force generator 32 is shown as a separate component from the anchors 30, in some embodiments, a force generating device may be incorporated into one or both of the anchors 30. For instance, slips (not shown) may be driven axial upward/downward and also radially outward. That is, the force generator 32 may be integrated into the anchor(s) 30 to generate the tension force in the isolated region.

In certain embodiments, the cutting tool 20 may include an information processing device 42, one or more sensors 44, and other electronics to monitor and control the cutting operation. Illustrative sensors include, but are not limited to, position sensors, temperature sensors, pressure sensors, and strain gages. The information processing device 42 may be a microprocessor having preprogrammed instructions that receives information from the sensors 44 and has bi-directional communication (i.e., uplink and downlink capability) with the surface (e.g., surface processor 19).

In some embodiments, the cutter 22 may include one or more spinning blades that precess such the spinning blades move gradually radially outward. The blades may be rotated using a hydraulically actuated motor. Devices such as gear drives may be used to transmit power from the motor to the blades. Other embodiments may use electric motors to rotate the blades. Also, in some embodiments, the cutter 22 may be a chemical cutter that dispenses a corrosive agent that removes the material making up the wellbore tubular 14. In other embodiments, the cutter 22 may include an energetic beam, such as a laser, that forms a weakened area in the tubular 14.

In an illustrative use, the cutting tool 20 is positioned in the wellbore 12 at a target location 50 at which the wellbore tubular 14 is to be severed. The tubular 14 at the location 50 may be subjected to compressive loadings that could impair or prevent the cutting operation. For example, the weight of the tubular 14 uphole of the location 50 could generate the compressive loading. In some situations, a surface structure as a rig may bear some of the weight of the tubing 14. In other situations, the tubular 14 is not actively supported by any surface structure. In either case, the anchors 30 are actuated to engage an inner surface of the tubing 14 at two points 34, 36. Next, the force generator 32 may be actuated to urge the anchors 30 in opposing directions. The axial force generated by the force generator 32 causes a localized reduction in the compressive force at the location 50, which is between the two points. That is, the compressive forces along the tubing 14 may be greater uphole of point 34 and/or downhole of point 36 than at the location 50.

Depending on the situation, the force generator 32 may generate an axial force that partially offsets the compression in the isolated region, balances the compression in the isolated region, or even cause the isolated region to be in tension. For example, the force generator 32 may be controlled to provide a tension force that reduces the compression in the portion of the tubular 14 at the location 50 to a value that allows the cutter 22 to cut progressively into the tubular 14 to form an upper section 52 and a lower section 54. The compression may be reduced to a value that prevents the sections 52, 54 from applying a force (e.g., a normal force) that substantially impedes movement of the cutter 22. Thus, where the cutter 22 includes a blade or blades, the compression is reduced to a point where the blades may at least partially sever the tubular 14 without having the blade(s) frictionally locked between the two sections 52, 54.

The cutter 22 is operated until the tubular 14 is separated into the sections 52, 54 or is sufficiently weakened such that an applied force or manipulation of the tubular 14 separates the sections 52, 54. That is, the cutter 22 may remove sufficient material such that the remaining material connecting the sections 52, 54 can be snapped, sheared, fractured, shattered or otherwise broken. If partially severed, the sections 52, 54 may be separated using the force applicator 24, a fishing tool (not shown) that may be used to retrieve the section 52, or some other method.

Figure 2:
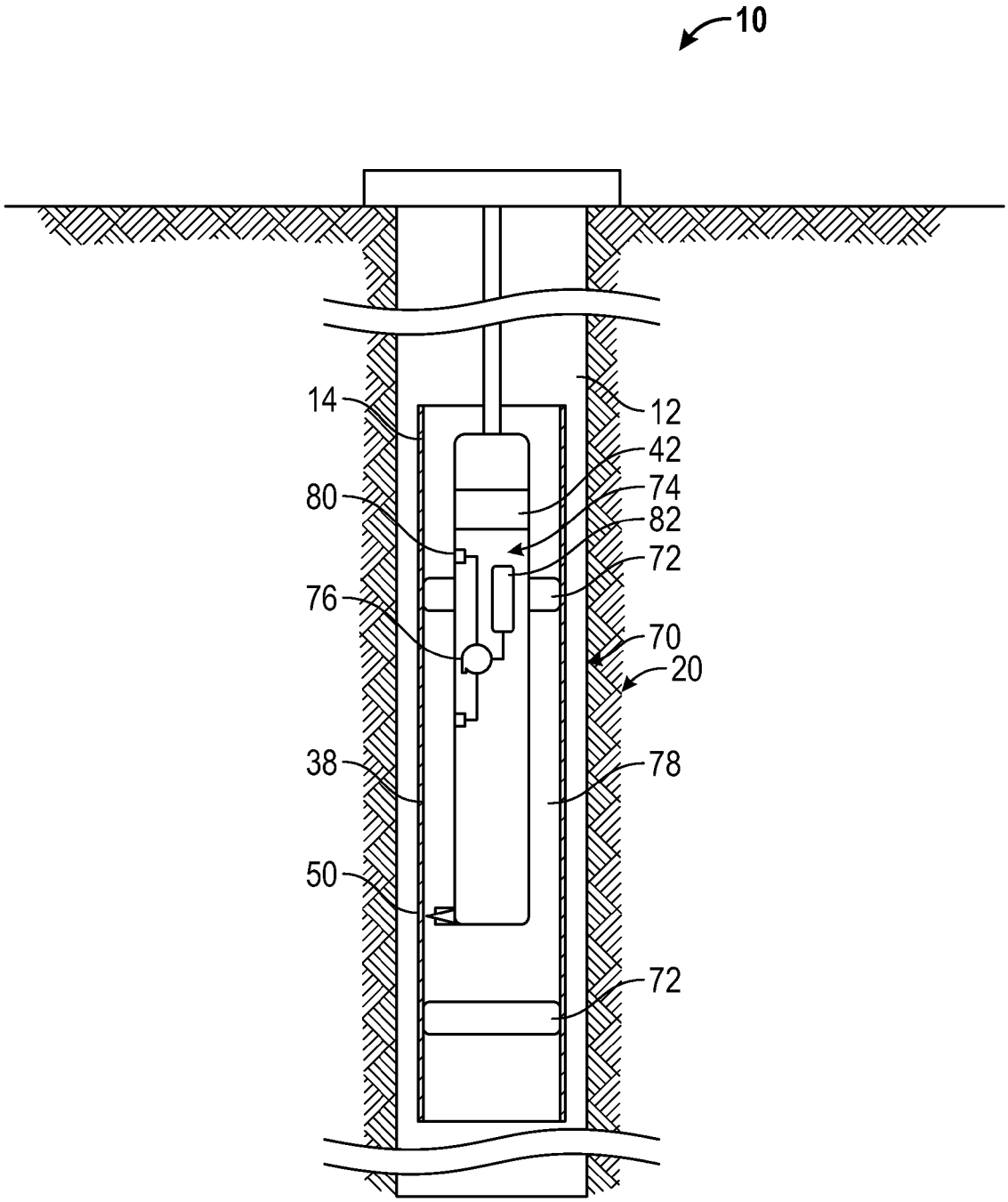
FIG. 2 schematically illustrates another embodiment of a cutting tool made in accordance with the present disclosure.

FIG. 2 illustrates another embodiment of the cutting tool 20 shown in a rig 10 positioned over a wellbore 12. In this embodiment, a tubular 14 does not extend to the surface. Thus, the tubular 14 cannot be supported by a rig or other structure at the surface. In some embodiments, the cutting device 20 may have been used to remove a section of tubular and/or other devices (e.g., packers) that connected the tubular 14 to the surface. In a sense, the tubular 14 may be considered "free-standing," but it should be understood that the tubular 14 may lie against or contact objects in the wellbore 12. In this embodiment, the cutting tool 20 includes a force applicator 70 that includes anchors 72 and a force generator 74. The anchors 72 may be similar to those shown in FIG. 1 and are not discussed in further detail. The force generator 74 in this embodiment uses a non-mechanical force generating mechanism. For example, the force generator 74 may include a pump 76 that pressurizes an interior volume 78 with a pressurized fluid. The fluid may be a resident wellbore fluid received via a line 80, a fluid from a downhole source 82, and/or supplied from the surface. The pressurized fluid applies pressure to the anchors 72 to generate a tension in a region in which the tubular 14 is to be severed. In another arrangement, the force generator 74 may include magnetic elements that apply opposing magnetic fields that repel the anchors 72 apart.

In an illustrative use, the cutting tool 20 is positioned in the wellbore 12 at a target location 50 at which the wellbore tubular 14 is to be severed. In a prior operation, the cutting tool 20 may have been used to remove a section of the wellbore tubular 14. For example, the cutter 20 may have been used to cut through slips of a packer (not shown). The removal of such a section prevents the tubular 14 from being supported at the surface. Thus, the tubular 14 at the location 50 may be subjected to compressive loadings that could impair or prevent the cutting operation. As before, the anchors 72 are actuated to engage the tubular 14. Next, the force generator 72 may be actuated to urge the anchors 72 in opposing directions. The axial force generated by the force generator 74 causes a localized reduction in the compressive force at the location 50.

It should be understood that the FIGS. 1 and 2 embodiments are merely illustrative. For example, in certain embodiments, the anchors and force generators may be positioned external to the tubular member; i.e., in the annulus.

Referring to FIGS. 1 and 2, several control methodologies may be used to control the cutting device 20. In one illustrative operating mode, personnel at the surface may initiate and monitor the cutting operation by using the surface controller 19. For instance, the downhole information processing device 42 may be programmed to activate the cutting device 20 upon receiving a command signal via a suitable carrier (e.g., wireline) from the surface.

In another operating mode, the cutting operation may be automated such that surface control is not used to initiate, control, and/or terminate the cutting operation. For example, the information processing device 42 may be programmed to initiate the cutting operation using pre-programmed instructions and one or more signal inputs. In some arrangements, the information processing device 42 may receive signals from a timer (not shown) that initiates a cutting operation after a pre-set amount of time has expired (e.g., thirty minutes). During such a time delay, the cutting device 20 may be lowered into the wellbore 12 and positioned at the proper depth. In another mode, a motion sensor (e.g., an accelerometer) generate signals that may be used to determine when the cutting device 20 has come to a rest at the target location 50. That is, a no detected motion period of a specified time duration may be indicative that the target location 50 has been reached. In still other embodiments, downhole parameters (e.g., tool orientation, temperature, pressure, etc.) may be measured in connection with the initiation of the operation of the cutting device 20. Thus, in some aspects, a memory of the information processing device 42 may include pre-programmed instructions that use one or more inputs (e.g., time, sensor measurements, etc.) in order to control the operation of the cutting device 20. It should be appreciated that such embodiments may be useful for use with conveyance devices such as slick line or coiled tubing that do not include communication carriers that enable direct surface control of the cutting device 20.

While the foregoing disclosure is directed to the one mode embodiments of the disclosure, various modifications will be apparent to those skilled in the art. It is intended that all variations within the scope of the appended claims be embraced by the foregoing disclosure.

What is claimed is:

1. A method for performing an operation in the wellbore, comprising:

gripping a wellbore tubular at two points;

urging the two points apart using a force applicator;

at least partially separating the wellbore tubular into a first and a second section while reducing a compressive force acting on the wellbore tubular using the force applicator in the wellbore, wherein the wellbore tubular is at least partially separated at a location between the two points.

2. The method of claim 1, wherein the wellbore tubular is separated using one of: (i) at least one cutting element, (ii) a chemical reaction, (iii) a shaped charge, and (iv) an energetic beam.

3. The method of claim 1, further comprising: positioning the force applicator inside the wellbore tubular.

4. The method of claim 1, further comprising applying an axial force to an inner surface of the wellbore tubular using the force applicator.

5. The method of claim 1, wherein a force applicator applies an axial force using one of: (i) a pressurized fluid, (ii) a magnetic force, (iii) a hydraulically actuated ram, (iv) a hydraulic motor, and (v) an electric motor.

6. The method of claim 1, further comprising: engaging the wellbore tubular with a first and a second anchor associated with the force applicator.

7. The method of claim 6, further comprising: (i) positioning a cutting device using at least one of: (i) the first anchor, and (ii) the second anchor.

8. The method of claim 1, wherein a tension force applied by the force applicator results in one of: (i) substantially no compression in the wellbore tubular section, and (ii) a tension in the wellbore tubular section.

9. An apparatus for performing a downhole operation, comprising:

a cutter positioned between a first location and a second location along a wellbore tubular, the cutter configured to at least partially sever the wellbore tubular into a first and a second section; and a force applicator configured to reduce a compressive force acting on a section of a wellbore tubular proximate to the cutter by urging the first location and the second location apart.

10. The apparatus of claim 9, wherein the cutter includes one of: (i) at least one cutting element, (ii) a chemical reaction, and (iii) an energetic beam.

11. The apparatus of claim 9, wherein the force applicator is configured to urge the first and the second sections in opposite directions.

12. The apparatus of claim 9, wherein the force applicator includes at least one anchor configured to engage an inner surface of the wellbore tubular.

13. The apparatus of claim 9, wherein a force applicator includes one of: (i) a pressurized fluid, (ii) a hydraulically actuated ram, (iii) a hydraulic motor, and (iv) an electric motor.

* * * * *